United States Patent [19]

Stewart et al.

[11] 4,439,875

[45] Apr. 3, 1984

[54] TOILET

[75] Inventors: John M. Stewart, River Drive Park; Clifford B. Hewson, West Vancouver, both of Canada

[73] Assignee: Sanitation Equipment Limited, Downsview, Canada

[21] Appl. No.: 269,434

[22] Filed: Jun. 2, 1981

[51] Int. Cl.[3] ..... E03D 5/012

[52] U.S. Cl. ..... 4/321; 4/315; 4/471; 251/147; 251/204

[58] Field of Search ..... 4/315, 321–323, 4/459, 466, 471, 473, 474, 434; 257/147, 186, 203, 204

[56] References Cited

U.S. PATENT DOCUMENTS

| | | | |
|---|---|---|---|
| 989,201 | 4/1911 | Snow | 251/204 |
| 3,232,470 | 2/1966 | Gibson | 215/DIG. 1 |
| 3,255,907 | 6/1966 | Eddy | 215/DIG. 1 |
| 3,801,991 | 4/1974 | Fulton et al. | 4/323 |
| 3,949,430 | 4/1976 | Miller et al. | 4/321 |
| 4,091,475 | 5/1978 | Hewson et al. | 4/321 |
| 4,136,712 | 1/1979 | Nogami et al. | 220/367 |
| 4,180,876 | 1/1980 | Sargent et al. | 4/321 |

*Primary Examiner*—Stephen Marcus
*Assistant Examiner*—Kenneth S. Putnam
*Attorney, Agent, or Firm*—Rogers, Bereskin & Parr

[57] ABSTRACT

A portable toilet having an improved valve arrangement for minimizing abrasion of the holding tank inlet seal. The valve arrangement includes a valve member which moves generally normal to a sealing plane defined by the seal when the valve is opened or closed. A wiper element is disposed adjacent the holding tank inlet and is positioned to exert a wiping action on the sealing surface of the valve member when the valve is operated.

16 Claims, 12 Drawing Figures

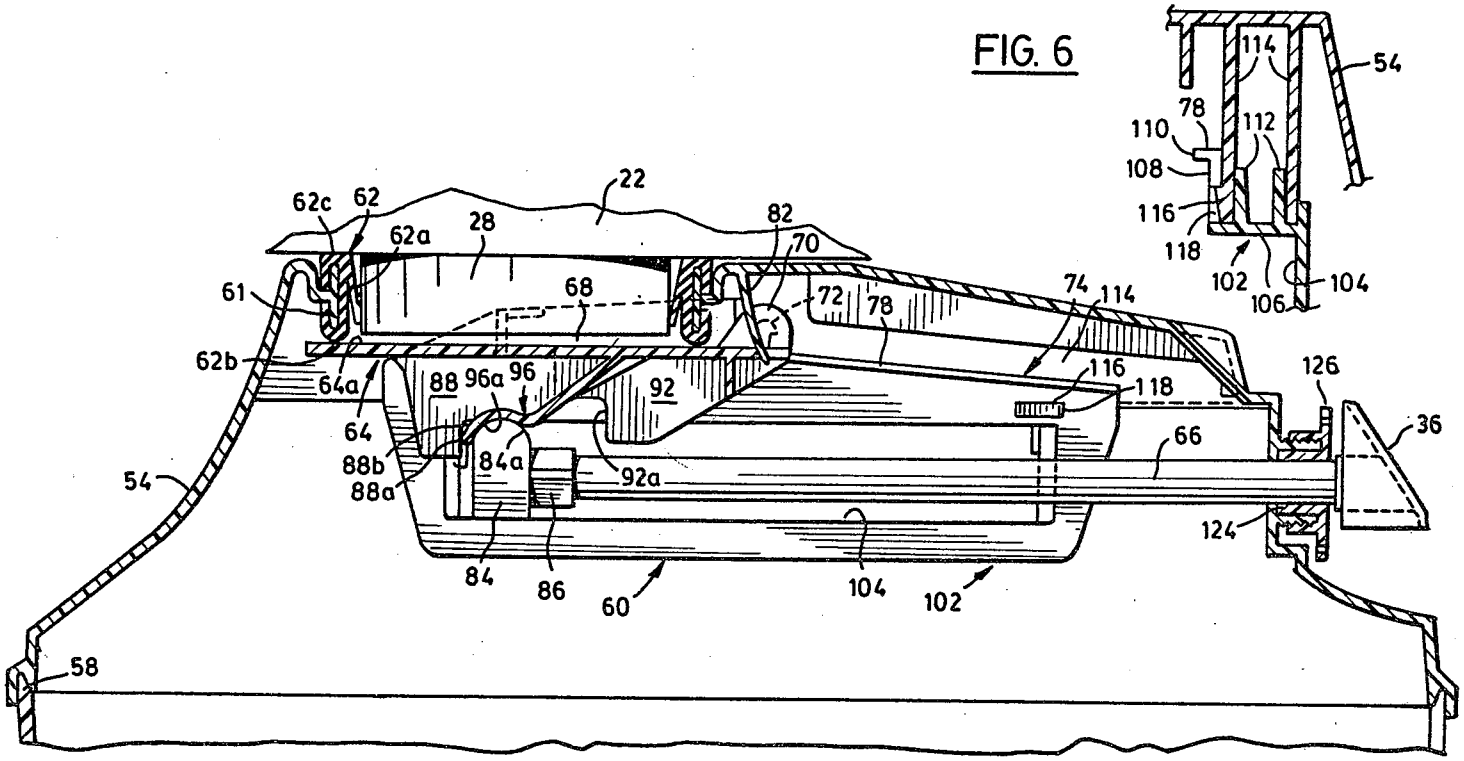
FIG. 6
FIG. 5
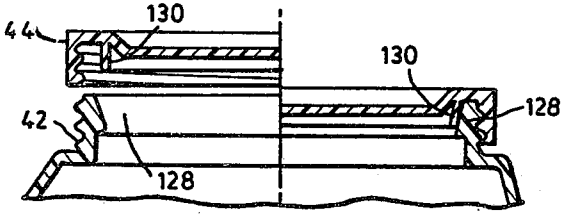
FIG. 4

TOILET

This invention relates generally to toilets of the type having a bowl and a holding tank in which waste material is collected. More particularly, the invention is concerned with valve means for toilets of this type.

Toilets having holding tanks are intended for use primarily in boats, trailers, cottages and in other locations lacking sewage facilities. A typical example of a toilet of this type is a two-piece portable toilet in which the holding tank is manufactured as a separate unit and is intended to be used with a bowl unit supported on the holding tank. The holding tank is fitted with a valve which normally closes an opening in the holding tank but which can be opened to allow waste material to pass from the bowl unit into the holding tank. Another example of a toilet having a holding tank is a so called "biological" or "composting" toilet.

United States Patent literature contains numerous examples of prior art valves for use of toilets of the type referred to above. For example, U.S. Pat. No. 4,091,475 Stewart discloses an example of a flap-type valve used in a two-piece portable toilet. U.S. Pat. No. 3,570,081 Sargent et al discloses a slide valve for use in a portable toilet. The valve is mounted on the holding tank for movement in a plane generally parallel to the parting surfaces between the holding tank and bowl unit. The holding tank inlet is fitted with a seal and the valve member slides across the seal in moving between its open and closed position. A serious disadvantage of this arrangement is that the valve member exerts an abrading action on the seal which causes rapid wear and premature deterioration of the seal. Also, this type of valve has a tendency to become clogged by paper or other waste material passing from the toilet bowl.

Object of the present invention is to provide an improved valve means designed to avoid these problems.

According to one aspect of the invention there is provided a toilet of the type having a holding tank for waste material, a bowl communicating with a waste material inlet of said tank, and valve means normally closing said inlet and adapted to be opened to permit waste material to enter the tank from the bowl. The holding tank inlet is provided with a seal defining an annular sealing surface disposed in a sealing plane within said tank and the valve means includes a valve member which is movable between open and closed positions, the valve member being disposed laterally of said inlet in said open position and having a sealing surface adapted to cooperate with said seal in said place when the valve member is in said closed position. The toilet also includes means supporting the valve member for movement (a) between said open position and an intermediate position in which the valve member is disposed below said inlet preparation to sealing the same while remaining below said sealing plane, and (b) generally normal to said sealing plane from said intermediate position to said closed position. Actuating means is coupled to said valve member and is operable from externally of the toilet to move the valve member between said open position and said intermediate position and between said intermediate position and said closed position. Accordingly, in the valve means of the invention, the valve member moves with respect to said annular sealing surface in directions generally normal to said sealing plane, for minimizing abrasion of the seal.

In order that the invention may be more clearly understood, reference will now be made to the accompanying drawings which illustrate a number of preferred embodiments of the invention by way of example, and in which, FIG. 1 is a perspective view of a two-piece portable toilet incorporating valve means in accordance with the invention, the toilet being shown partly exploded;

FIGS. 4 and 5 are vertical sectional views taken respectively along lines IV—IV and V—V of FIG. 1;

FIG. 6 is a vertical sectional view on line VI—VI of FIG. 5;

Figure 1:
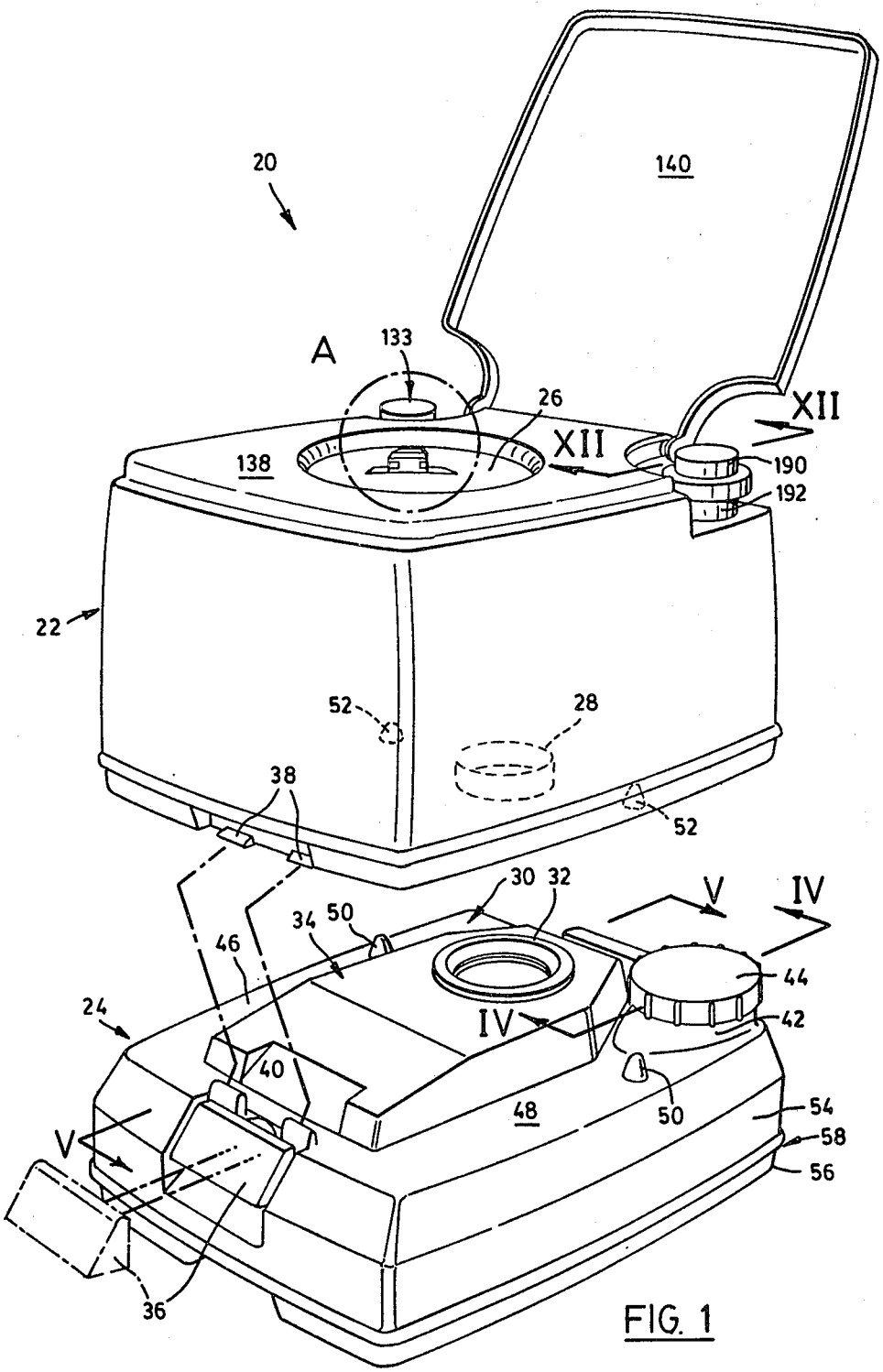
Figure 7:
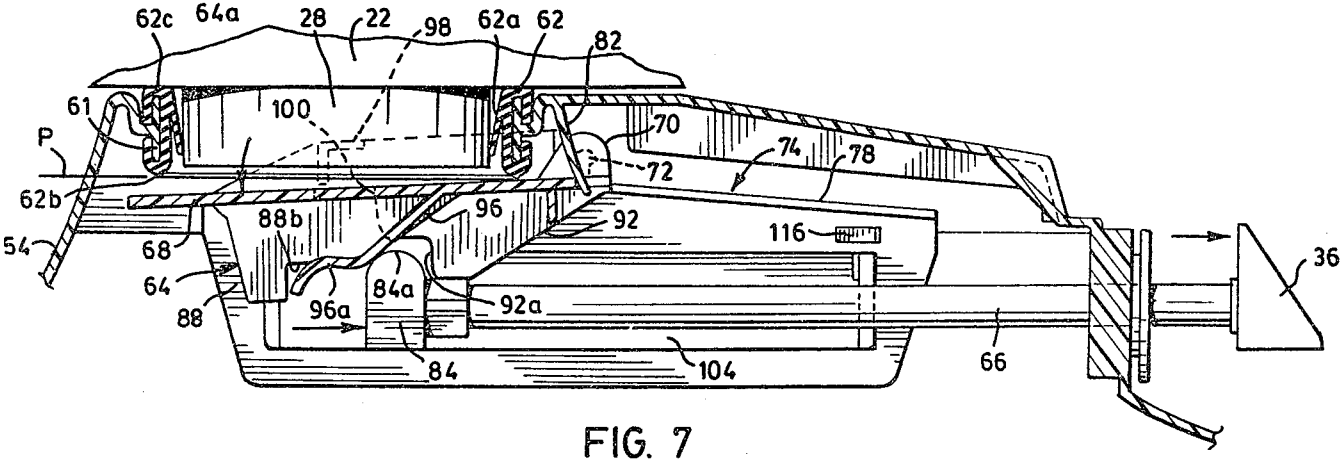
FIGS. 7 and 8 are longitudinal sectional views similar to FIG. 5 and show the valve mechanism in two sequential positions during opening of the holding tank inlet.
Figure 8:
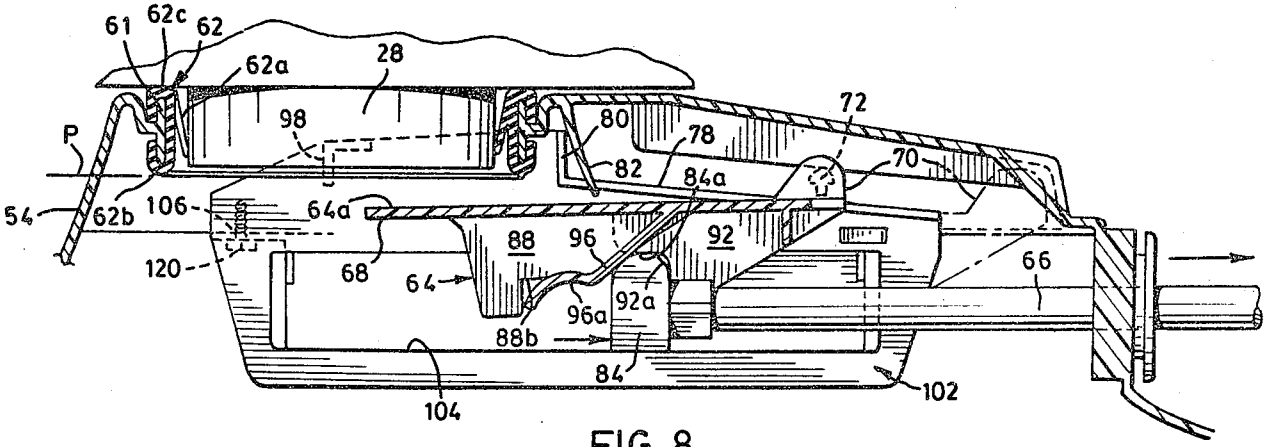

Referring first to FIG. 1, the toilet is generally indicated by reference numeral 20 and includes a bowl unit 22 and a holding tank 24. The bowl unit includes a toilet bowl 26 having an outlet which is indicated in dotted outline at 28 in FIG. 1 and which is also shown in FIGS. 5, 7 and 8. The holding tank 24 is adapted to support the bowl unit when the toilet is assembled although the bowl unit is shown in an exploded position above the holding tank in FIG. 1. The holding tank has an upper wall generally denoted by reference numeral 30 which includes an inlet 32 adapted to cooperate with the bowl outlet 28 (see FIG. 5) when the bowl unit is supported on the holding tank.

Reference numeral 34 generally indicates a formation in the upper wall of the bowl unit which houses the valve mechanism of the toilet (see later). An operating handle 36 is provided for the valve mechanism and is movable between the "in" position in which it is shown in full lines in FIG. 1 (in which the valve is closed) and the "out" position shown in ghost outline (in which the valve is open). The valve mechanism and its actuating means will be described in more detail later primarily with reference to FIGS. 2 to 8.

With continued reference to FIG. 1, it is to be noted that the bowl unit and holding tank are normally coupled together by disengageable coupling means comprising a cooperable latch and keeper and interengageable coupling formations. This coupling arrangement forms the subject of a co-pending patent application of even date herewith entitled "PORTABLE TOILET" and will not therefore be described in detail here. For present purposes, it is sufficient to note that these coupling means comprise a pair of projections 48 which extend forwardly from the lower front edge region of the bowl unit 22 and which are received in complimentary socket formations 40 on the holding tank. A latch (not shown) is carried by the bowl unit adjacent its rear lower edge and is adapted to snap fit with a keeper bar on the holding tank. In this way, the bowl unit and holding tank are detachably coupled together but can be released from one another to permit the holding tank to be emptied at the appropriate times. Reference numeral 42 in FIG. 1 denotes an emptying spout which projects upwardly from the holding tank and which is closed by a screw cap 44. The upper wall 30 of the holding tank also includes generally flat surface portions 46 and 48 which are disposed on respectively opposite sides of the valve housing 34 and which provide supporting surfaces on which the bowl unit rests. Two locating projections 50 extend upwardly from these surface portions and are received in complimentary recesses 52 in bowl unit 22.

Holding tank 24 comprises upper and lower moulded plastic shells which are denoted respectively 54 and 56 in FIG. 1 and which meet at a joint line which is generally indicated at 58 and which is shown in section in FIG. 5. The two shells are secured together by adhesive. The upper shell 54 carries the valve mechanism of the toilet and is shown separate from the lower shell and as seen from inside in FIGS. 2 and 3. The valve mechanism itself is generally indicated by reference numeral 60 in those views and is seen in perspective. FIGS. 5, 7 and 8 show the valve mechanism in vertical section.

With particular reference to the latter three views, it will be seen that the upper holding tank shell 54 defines around inlet 32, a flange 61 which extends generally parallel to the axis of the inlet. A seal 62 is fitted to flange 61 and defines a conical lip seal **62*a* which seals against the external surface of the bowl outlet 28. The seal also defines at its lower side an annular sealing surface 62*b* disposed in a sealing plane denoted P within the holding tank. A corresponding annular sealing surface 62*c* at the upper side of seal 62 also seals against the lower surface of bowl unit 22. Thus, seal 62 is designed to fulfil three sealing functions. In order for liquid to leak from the holding tank inlet when the valve is closed, the liquid must first pass the seal formed by surface 62*b*, then lip seal 62*a*, and finally the seal formed by surface 62*c***.

Figure 2:
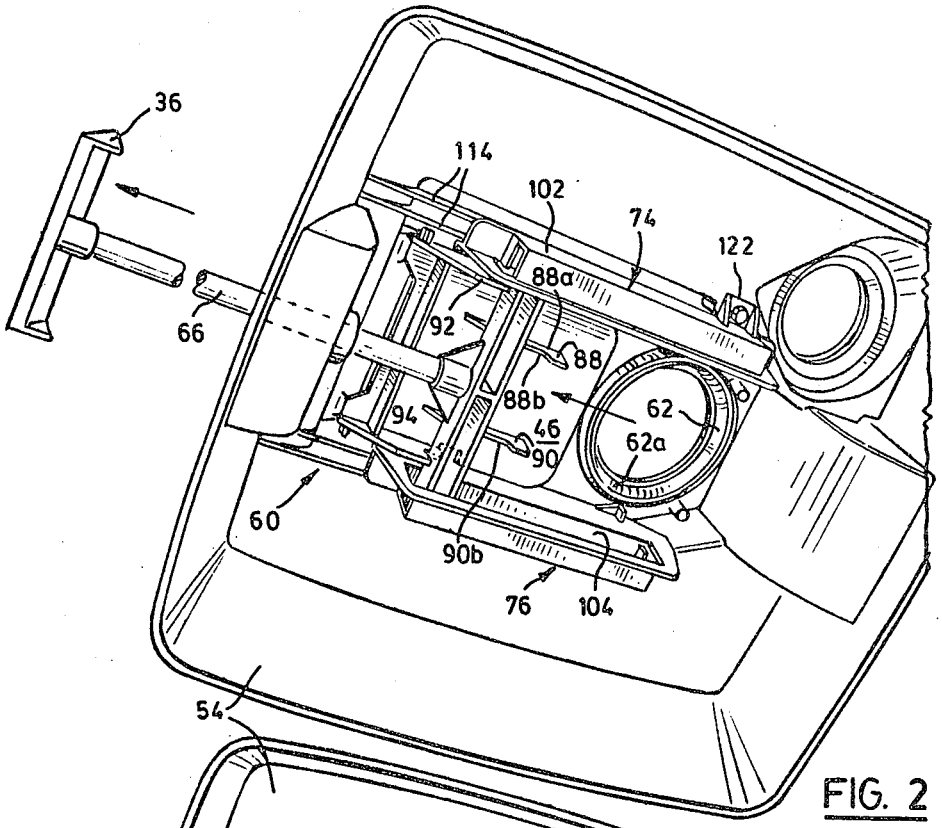
FIGS. 2 and 3 are underneath perspective views of the valve mechanism of the toilet as seen from inside the holding tank, the valve mechanism being shown respectively in its open position and in its closed partition in said views.
Figure 3:
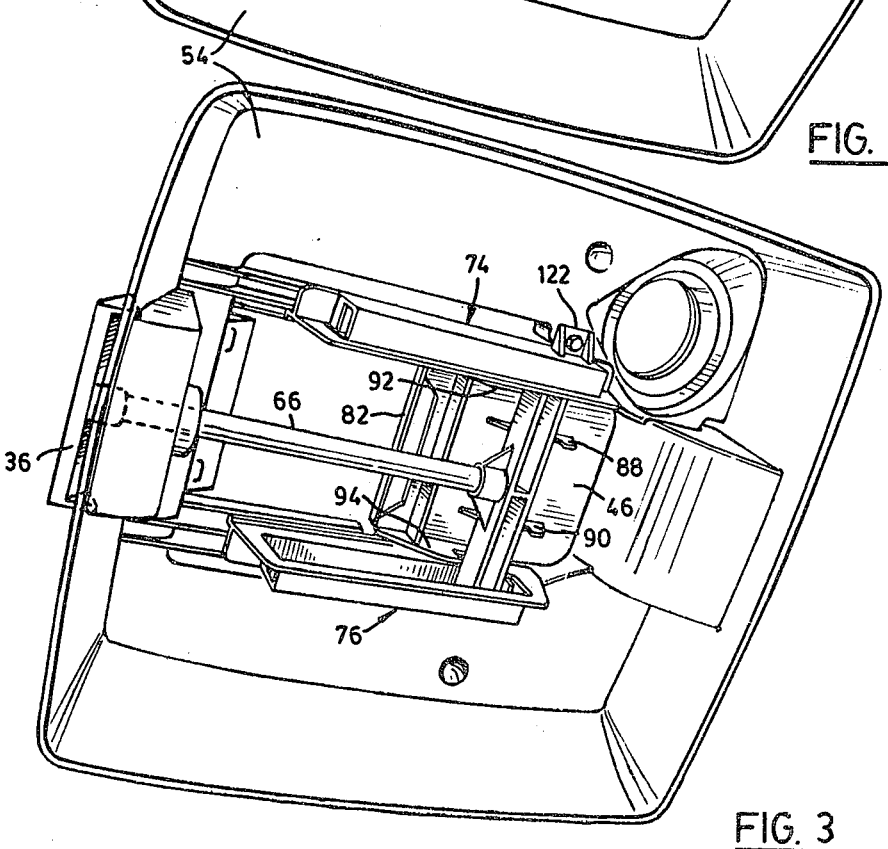

Valve mechanism 60 includes a valve member 64 which is movable between an open position in which it is shown in FIGS. 2 and 8 and a closed position in which it is shown in FIGS. 3 and 5. The valve member is disposed laterally of the holding tank inlet 32 in its open position (FIG. 2) and has a sealing surface **64*a* adapted to cooperate with seal 62 in plane P when the valve member is in its closed position (FIGS. 3 and 5**).

The valve mechanism includes means supporting the valve member both for movement laterally with respect to inlet 32 and in a direction generally normal to the sealing plane P of seal 62. Thus, the valve member is designed to move laterally from its open position (FIG. 2) to an intermediate position (FIG. 7) in which the valve member is disposed below inlet 32 preparatory to sealing the same while remaining the below the sealing plane P. The member can then be moved generally normal to plane P between its intermediate position and its closed position. Conversely, when the valve is to be opened, it can be moved downwardly in a direction generally normal to plane P but away from seal 62 to the intermediate position, and then laterally to its open position. In this way, the valve member always moves with respect to the annular sealing surface **62*b* of seal 62 in directions generally normal to sealing plane P so that abrasion of the seal is minimized. This movement of the valve member is effected by actuating means including the handle 36 referred to in connection with FIG. 1 and an actuating rod 66 which extends into the casing of the toilet from handle 36** and which is coupled to the valve member as will be described later.

Referring now particularly to FIGS. 5, 7 and 8 in more detail, valve member 64 is a unitary plastic molding comprising a plate portion 68 having a flat upper surface defining said sealing surface. A pair of lugs, one of which is indicated at 70 project upwardly from opposite sides of portion 68 adjacently the trailing end of the valve member as considered moving from its open position to its closed position. Two pivot formations 72 project outwardly from the respective lugs and are supported on guide surfaces of respective guide assemblies 74 and 76 as best seen in FIGS. 2 and 3. Guide assembly 74 is seen in side elevation in FIGS. 5, 7 and 8 and the guide surface for pivot formation 72 is indicated at 78. It will be seen that the surface slopes upwardly with respect to plane P towards the inlet opening 32. A corresponding surface of the other guide assembly 76 extends parallel to surface 78 so that the valve member 64 will ride up those surfaces in moving from its open position to its intermediate and closed positions. In FIG. 8, the valve member is shown partway along the guide surface 78; the fully open position of the valve member is shown in ghost outline and it will be seen that the pivot formation 72 will have moved clear of guiding surface 78 at this time. It will also be seen from this view that guide assembly 74 defines a stop 80 at the end of guiding surface 78 adjacent inlet 32 against which pivot formation 72 abuts when the valve member reaches its intermediate position. A corresponding stop is provided on guide assembly 76.

It will be apparent that pivot formation 72 and the corresponding formation at the other side of the valve member together form floating pivots and define a pivot axis for valve member 64. The guide assemblies 74 and 76 are arranged so that, when the valve member reaches its intermediate position below inlet 32, the valve member is disposed in an attitude in which its sealing surface **64*a* is inclined downwardly below sealing plane P (see FIG. 7). The actuating means of the valve mechanism is then adapted to cause the valve member to pivot about this axis to bring surface 64*a* into contact with seal 64** in a direction generally normal to plane P as will be described.

Valve member 64 is maintained clear of seal 62 in moving from its open position to the intermediate position of FIG. 7 by a wiper element 82 which depends from shell 54 adjacent inlet 32. The wiper element is in the form of a thin and flexible blade moulded integrally with shell 54 and is dimensioned to extend across the entire width of the valve member and arranged to wipe across the sealing surface of the member as it moves to and from its intermediate position. Thus, element 82 not only ensures that the valve member is maintained clear of seal 62, but also wipes the sealing surface **66*a*** of the valve member as the member moves away from its intermediate position towards its open position. In this way, waste material which might otherwise cause sealing problems is removed from the sealing surface each time the valve is operated.

The valve member is moved between its various positions under the control of the actuating handle 36 by way of an operating bar 84 which is secured transversely to the inner end of the actuating rod 66 of the valve actuating means. Bar 84 in fact forms part of a plastic moulding including a socket 86 which receives the inner end of rod 66. Bar 84 is arranged to co-operate with respective pairs of ribs 88, 90, 92 and 94 which depend from the underside of plate portion 68 of the valve member. The ribs can best be seen in FIGS. 2 and 3 but in FIGS. 5, 7 and 8 one rib in each pair is visible (88 and 92). It will be seen from these views that the ribs are shaped to define respective vertical shoulders, denoted 88*a* and 92*a* and that rib 88 has a horizontal shoulder or edge 88*b*. Rib 90 has a corresponding edge 90*b* (FIG. 2). The respective vertical shoulders 88*a* and 92*a* (FIGS. 5, 7 and 8) are spaced in the direction of travel of the valve member so that a degree of lost motion is possible between the valve member and bar 84. Thus, it will be seen particularly from FIG. 8 that bar 84 will abut against shoulder 92*a* of rib 92 (and the corresponding shoulder of rib 94) when the handle is moved outwardly to open the valve. Conversely, when handle 36 is pushed in, bar 84 will move away from the two shoulders of ribs 92 and 94. However, the bar will be prevented from abutting against the shoulders of formations 88 and 90 because of the presence of a thin and flexible spring member 96 (see particularly FIG. 7) which is moulded integrally as part of valve member 64 and which depends from plate portion 68 in the path of the bar; the purpose of spring member 96 will be described later.

The horizontal shoulders 88*b* and 90*b* of ribs 88 and 90 respectively co-operate with bar 94 to tightly urge valve member 84 into its fully closed position. Thus, it will be seen from FIGS. 5, 7 and 8 that bar 84 has a convex upper surface 84*a*. This surface is designed to act as a cam surface in co-operation with the horizontal shoulders 88*b* and 90*b* when the actuating handle 36 of the valve mechanism is moved to its fully "in" position (i.e. from the position of FIG. 7 to the position of FIG. 5). The horizontal shoulders 88*b* and 90*b* will progressively ride up the convex upper surface 84*a* of bar 84 at this time, urgining the sealing surface of valve member 64 tightly against seal 62. In the fully closed position of the valve member, bar 84 is disposed directly on a diametral centreline of seal 64 for optimum sealing efficiency.

Spring member 96 is designed to in effect provide a latch for retaining bar 84 in the position in which it is shown in FIG. 5 when the valve is fully closed so as to prevent any possibility that the valve might accidently open, for example, if the toilet were lifted from its rear side. Spring member 96 has adjacent its outer end a concave portion or "seat" 96*a* for receiving the convex upper surface 84*a* of bar 84, and is shaped so that bar 84 will initially contact the spring member at a position slightly in advance of seat 96*a* (considering bar 84 moving from the open position of the valve from right to left in FIG. 8). Continued movement of the bar in that direction after initial contact with spring member 96 will cause the valve member as a whole to move to the left. The valve member is designed to slide fairly freely in the guide assemblies 74 and 76 and accordingly such movement will cause the valve member to move to its intermediate position in which it is shown in FIG. 7; the spring member is sufficiently stiff to prevent 84 "riding over" into seat 96*a* during this movement.

When the valve member is fully seated in its intermediate position shown in FIG. 7 (as defined by abutment of the pivot formations on the valve member with the stops of the respective guide assemblies—as abutment of formation 72 with stop 80) the valve member stops moving. Continued inward movement of actuating handle 36 will now cause bar 84 to ride along the horizontal shoulders 88*b* and 90*b* of ribs 88 and 90, closing valve member 64 (FIG. 5). At the same time, bar 84 will snap into seat 96*a* of member 96 and be retained by spring member 96 until the valve is opened by pulling on handle 36.

A pair of stop formations are provided adjacent respective side edges of the sealing surface 64*a* of valve member 74 and to prevent valve member 64 moving laterally with respect to the annular sealing surface 62*b* of seal 62. One of the stop formations is visible at 98 in FIGS. 5, 7 and 8 and is shown in perspective in FIG. 2; a corresponding formation is provided at the opposite side of the valve member but is not visible in the drawings. The valve member is provided with slots in its respective side margins which allow the valve member to pivot upwardly into or downwardly from plane P only when the slots reach the positions of the stop members (but not before). The slot associated with stop 98 is visible in dotted lines at 100 in FIG. 7.

FIGS. 7 and 8 illustrate opening of the valve. Thus, movement of handle 36 to the right from the position of FIG. 5 will first cause bar 84 to disengage from the seat 96*a* in spring member 96. The valve member will not move down at this time because of the engagement of stop formations (as formation 98) in the slots in the valve member. Continued movement of handle 36 to the right will cause bar 84 to contact the vertical shoulders of the ribs 92 and 94 at the underside of the valve member and cause the valve member to pivot downwardly; when the stop formations have been cleared the valve member can move freely to the right as seen in FIGS. 7 and 8. In other words, the valve member will move downwardly in a direction generally normal to and away from seal 64 and will move laterally away from the holding tank inlet 32. At the same time, the wiper element 82 will clean any debris remaining on the sealing surface or the valve member. Finally, the valve member will reach the fully open position indicated in ghost outline in FIG. 8.

Each of the guide assemblies 74 and 76 comprises a plastic moulding secured to the underside of the holding tank upper shell 54. The two mouldings are essentially the same but of opposite hand and therefore only the moulding which forms part of guide assembly 74 will be described. That moulding is visible in elevation in FIG. 5 and is denoted by reference numeral 102 in that view. It will be seen that the moulding defines an elongate slot or recess 104 which forms a guideway receiving an end portion of bar 84 (see also FIGS. 2 and 3). It will be appreciated that the bar is accordingly guided for longitudinal sliding movement in the guideways of the two guide assemblies 74 and 76. The sealing pressure exerted on the valve member is developed between the lower surface of these guideways and the horizontal shoulders 88*b* and 90*b* at the underside of the valve member.

FIG. 6 is a sectional view on line VI—VI of FIG. 5 and shows part of guideway 104. At the top of the guideway is a horizontal flange portion 106 from an inner edge of which a vertical web 108 extends upwardly; this web has an outwardly directed flange 110 along its upper edge which defines the guide surface 78 referred to above. A pair of parallel ribs 112 project upwardly from horizontal flange portion 106 and are received between a corresponding pair of parallel webs 114 which depend from shell 54 and are integrally molded therewith. One of these webs is also visible in elevation in FIG. 5 and it will be seen that the web extends over substantially the entire length of the valve mechanism housing formed in shell 54. The innermost one of these webs 114 is provided on its outer surface with a projection 116 which locates in a corresponding opening 118 in the vertical web of molding 102. This locking arrangement serves as the rear attachment point securing molding 102 to shell 54. Adjacent is forward end, a self-tapping screw 120 extends through an opening in horizontal flange 106 (see FIG. 8) and is received in an appropriately positioned lug (not shown) molded into shell 58. Located adjacent the position of screw 120 is a laterally extending bracket which also receives a self-tapping screw. That particular bracket is not shown in the drawings but the corresponding bracket on guide assembly 76 is shown at 122 in FIGS. 2 and 3). These two brackets are arranged on the diametral centreline of seal 62 on which the valve sealing pressure is developed by bar 84.

To summarize, the guide assemblies 74 and 76 serve not only to guide bar 84 for longitudinal sliding movement back and forth under the control of the actuating handle 36, but also to guide the valve member 66 for movement between its closed position as indicated in ghost outline in FIG. 8, and its intermediate position as shown in FIG. 7. The guide assemblies then support the valve member by way of its pivot formations (as formation 72) for pivotal movement between its intermediate position and the fully closed position of FIG. 5. This two stage or compound movement of the valve member is derived solely from axial movement of actuating rod 65 under the control of handle 36. If handle 36 is moved smoothly outwardly from the "valve closed" position of FIG. 5, that single movement will allow the valve member to move first downwardly to its intermediate position and then laterally to the "valve open" position. Conversely, inward movement of handle 36 will bring the valve member first to the intermediate position of FIG. 7 and will then cause the valve member to pivot upwardly into its fully closed position as shown in FIG. 5.

A ring seal 124 is provided around actuating rod 65 (FIG. 5) and is received in a housing moulded integrally as part of shell 54. A screw threaded cap 126 retains the seal in position and can be adjusted in the field, e.g. in the event that a leak should develop.

Figure 11:
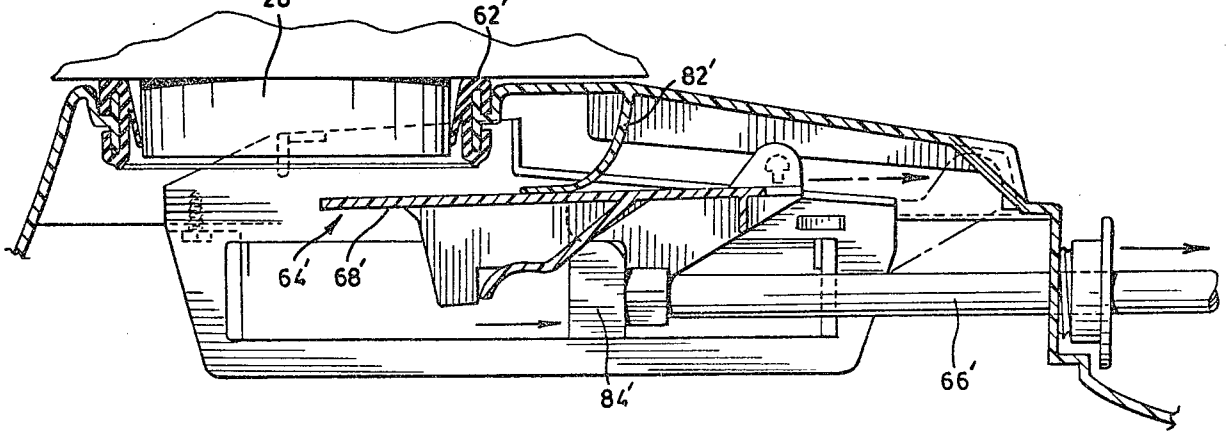
FIG. 11 is a view similar to FIG. 8 showing a modified form of valve mechanism; and, FIG. 12 is a vertical sectional view on line XII—XII of FIG. 1.

Before describing the remaining drawings, it may be convenient to briefly refer to FIG. 11 which illustrates a modification of the valve mechanism. FIG 11 essentially corresponds to FIG. 8 and primed reference numerals have been used in FIG. 11 to denote parts which correspond with FIG. 8. FIG. 11 differs from FIG. 8 in that the wiper element 82' in FIG. 11 is significantly longer than the element 82 shown in the previous views. Element 82' is moulded as a simple straight, depending flap on shell 54 and is subsequently deflected in the direction of inlet 32' so that the outer end portion of the flap lies flat on the sealing surface of the valve member 66'. Consequently, the wiper element remains in contact with the valve member at all times so that the valve member is always positively biassed downwardly and is repeatedly scraped by the wiper element each time the valve is operated.

It may also be convenient at this stage to briefly refer to FIG. 4 which is a vertical sectional view on line IV—IV of FIG. 1 and illustrates a further feature of the toilet. In that view, the emptying spout of the holding tank is shown at 42 and its cap 44 is shown at the left-hand side of FIG. 4 partly exploded above the spout in order to illustrate an annular compression ridge 128 which extends around the mouth of the spout and which is designed to co-operate with a flexible annular lip 130 which depends from the top of cap 44. When cap 44 is screwed down onto the spout, the compression ridge deflects lip 130 inwardly as shown at the right-hand side of FIG. 4 for maintaining a tight seal between the cap and spout.

Figure 9:
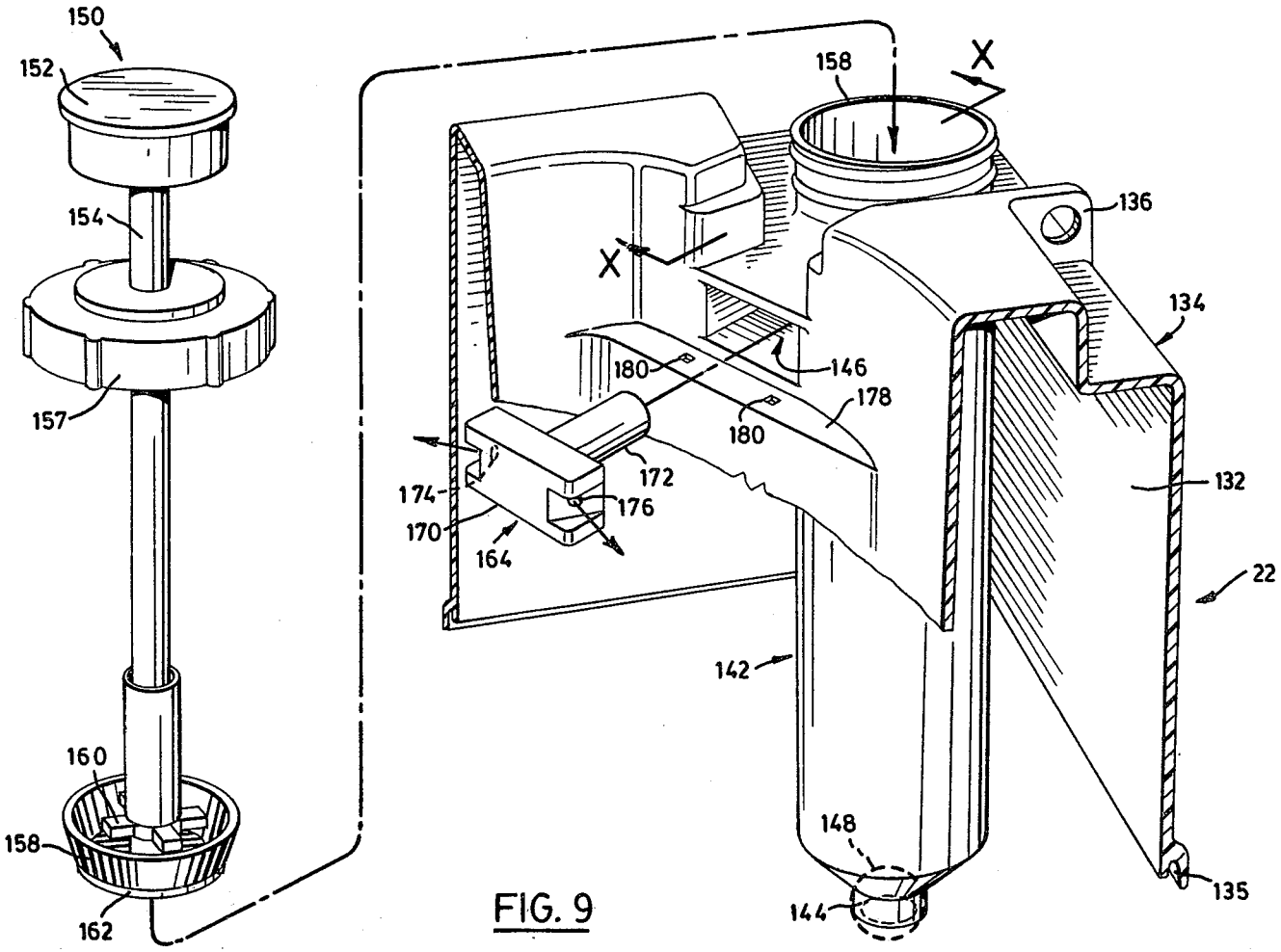
FIG. 9 is an enlarged detail view, partly exploded, of the part of FIG. 1 indicated at A.

Reference will now be made to FIG. 9 which illustrates part of the flushing mechanism of the toilet shown in the previous views. Thus, the bowl unit 22 of the toilet includes a flush liquid reservoir 132 which extends around the bowl of the toilet and from which liquid can be dispensed into the bowl by means of a pump generally indicated at 133 in FIG. 1 for the purpose of flushing debris through the bowl outlet 28. The reservoir itself has not been shown in detail in the drawings because it forms no part of the present invention and is essentially the same as that disclosed in U.S. Pat. No. 4,091,475 referred to above. For present purposes, it is sufficient to note that the reservoir and bowl are defined by respective upper and lower unitary plastic mouldings; part of the upper moulding is shown at 134 in FIG. 9 and meets the lower moulding at a joint line 135. Moulding 134 also defines pivot points, one of which is indicated at 136, for the seat and lid of the toilet as denoted respectively 138 and 140 in FIG. 1. A generally cylindrical pump chamber 142 extends downwardly into the reservoir. It is important to note that chamber 142 is integrally formed as part of moulding 134. The chamber is provided with an inlet 144 at its lower end and a laterally directed outlet 146 adjacent its upper end. A ball 148 is provided for normally closing inlet 144 under the effect of gravity.

A pump assembly is generally indicated at 150 in FIG. 9 and is again generally similar to that described in the patent referred to above. It includes an operating handle at 152 disposed at the upper end of a rod 154 which slides through a screw cap 156 intended to be fitted to a screw threaded neck 158 on molding 134. Adjacent its lower end, rod 154 is fitted with a cup seal 158 which is retained between a cross-shaped formation 160 and a disc 162 at the lower end of rod 154 so that the seal can move axially of the rod to a limited extent. Seal 158 has a circular opening where the rod extends through the seal and the portion of the rod within the seal is of square shape. Thus, when the pump assembly is in position in chamber 42, upward movement of the pump rod 154 will cause seal 158 to move down against disc 162 so that liquid will be drawn into chamber 142 through inlet 144. Conversely, when rod 154 is moved downwardly, seal 158 will move up so that liquid will flow through the opening in the seal into the portion of chamber 142 above the seal, and out through outlet 146.

Figure 10:
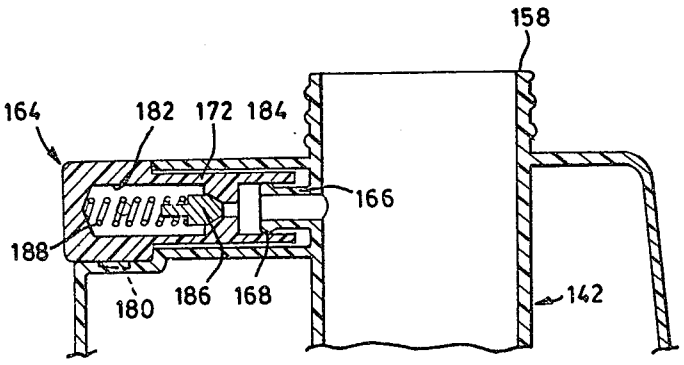
FIG. 10 is a partial sectional view on line X—X of FIG. 9.

Outlet 146 is fitted with a nozzle 164 which is shown in an exploded position in FIG. 9 and in section in FIG. 10. It will be seen from the latter view that pump chamber outlet 146 includes a relatively small diameter cylindrical spigot 166 which projects outwardly from the main body of the pump chamber inside outlet 146 and which has a protuberant rib 168 around its outer end. Nozzle 164 includes an outer portion 170 of generally rectangular shape and a cylindrical projection 172 designed to be press-fitted over spigot 166. Projection 172 has an internal passageway which communicates with outlets 174 and 176 (FIG. 9) disposed to direct divergent streams of flushing liquid into the toilet bowl when the pump is operated. In an alternative embodiment, a single flushing liquid outlet could of course be provided.

It will also be noted from FIG. 9 that a ledge 178 is provided below outlet 146 and includes two generally rectangular shaped depressions 180. These depressions receive complimentary projections on the underside of portion 170 of nozzle 164. Thus, the nozzle can be simply press-fitted into outlet 146 and will be located by engagement of these projections in recesses 180. This construction had been found to be particularly convenient for ease of manufacture while at the same time allowing efficient distribution of flushing liquid from the pump into the toilet bowl.

FIG. 10 also shows a non-return valve which is provided in the internal passageway of nozzle 164. The passageway is denoted 182 in FIG. 10 and is formed with a transverse internal wall 184 having an opening which is normally closed by a valve element 186 biassed by a compression spring 188. Thus, element normally maintains the nozzle passageway closed but will open when the flushing liquid pump of the toilet is operated to dispense flushing liquid through nozzle 164. This non-return valve arrangement has the advantage of preventing any possibility of syphoning of contaminated liquid from the bowl back into the flushing system of the toilet.

Figure 12:
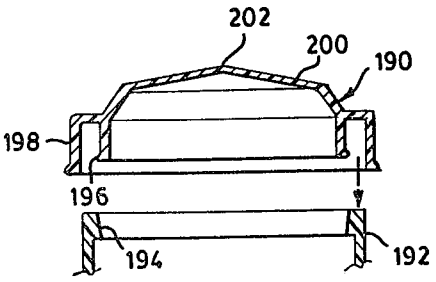

FIG. 12 is a vertical sectional view on line XII—XII of FIG. 1 and shows a closure cap 190 for the flushing liquid inlet 192 of the toilet reservoir 132. Inlet 192 is of cylindrical shape and defines an inwardly protuberant rib 194 around its mouth. Cap 190 defines respective inner and outer annular skirts 196 and 198 dimensioned to fit respectively inside and around inlet 192. Skirt 196 has an outward annular protrusion around its lower end which co-operates with rib 194 to permit cap 190 to be snap-fitted onto inlet 192. Thus, the protrusion 196 and rib 194 snap over one another when the cap is fitted to the inlet so that the cap is retained in place but can be forceably removed by causing the protrusion and rib to ride back over one another. The cap has a central dome 200 formed with a vent hole 202.

It will of course be appreciated that the preceding description relates to preferred embodiments of the invention only and that many modifications are possible within the broad scope of the claims. For example, the design of the valve member and its actuating mechanism as shown in the drawings have been found to be particularly convenient both in terms of manufacture and operation although it is not essential within the broad scope of the invention. Thus, the valve member need not necessarily be pivotally mounted in the valve mechanism but could be designed to move parallel to the sealing plane of the holding tank inlet seal.

We claim:

1. A toilet of the type having a holding tank for waste material, a bowl communicating with a waste material inlet of said tank, and valve means normally closing said inlet and adapted to be opened to permit waste material to enter the tank from said bowl, wherein said holding tank inlet is provided with a seal defining an annular sealing surface disposed in a sealing plane within said tank, and wherein said valve means comprises:

a valve member which is movable between open and closed positions, the valve member being disposed laterally of said inlet in said open position and having a sealing surface adapted to cooperate with said seal in said plane when the valve member is in said closed means supporting said valve member for movement (a) between said open position and an intermediate position in which the valve member is disposed below said inlet preparatory to sealing the same while remaining below said sealing plane, and (b) generally normal to said sealing plane between said intermediate position and said closed position;

actuating means coupled to said valve member and operable from externally of the toilet to move the valve member between said open position and said intermediate position and between said intermediate position and said closed position;

whereby the valve member moves with respect to said annular sealing surface in directions generally normal to said sealing plane for minimizing abrasion of said seal;

and wherein the toilet further comprises a wiper element disposed adjacent said holding tank inlet and positioned to exert a wiping action on said sealing surface of the valve member as the member moves between said open position and said intermediate position.

2. A toilet as claimed in claim 1, wherein said valve member is supported for pivotal movement between said intermediate position and said closed position about an axis disposed adjacent a trailing end of said valve member as considered moving from said open position to said intermediate position, and wherein the valve member in said intermediate position is disposed with its sealing surface at an inclination below said sealing plane and so that said sealing surface moves into said plane when the valve member is moved to its closed position.

3. A toilet as claimed in claim 2, wherein said valve member includes pivot formations projecting from respective by opposite sides of the member, and wherein said means supporting the valve member include respective guide assemblies cooperable with said pivot formations and including respective guide surfaces along which said formations slide as the valve member moves between its said open position and its said intermediate position.

4. A toilet as claimed in claim 3, wherein said guide surfaces are inclined upwardly towards said sealing plane so that the valve member moves upwardly towards said plane as said formations travel along said guide surfaces.

5. A toilet as claimed in claim 1, further comprising means preventing movement of the valve member into and from said closed position except in directions generally normal to said sealing plane.

6. A toilet as claimed in claim 1, wherein said wiper element comprises a blade which is of a resilient and flexible material and which is dimensioned and arranged in a curved configuration in which it exerts a resilient biassing influence on said valve member in a direction away from said seal so as to assist in maintaining the valve member clear of the seal as the member moves from its open to its intermediate position.

7. A toilet as claimed in claim 3, wherein said actuating means includes an actuating rod which is axially displaceable from externally of the toilet in general directions corresponding to the direction of movement of the valve member between said open position and said intermediate position, and wherein said actuating means further includes means at an inner end of said rod co-operable with said valve member and adapted to cause movement of the valve member from said open position to said intermediate position and from said intermediate position to said closed position in response to inward axial sliding movement of the rod and converse movement of said valve member from said closed position to said open position upon axial movement of the rod outwardly of the toilet.

8. A toilet as claimed in claim 7, wherein said means co-operable with the valve member comprise a bar extending transversely of said inner end of the actuating rod and disposed below said valve member, said bar and valve member having cam surfaces adapted to co-operate to urge said valve member into said closed position in response to continued movement of the bar with respect to the valve member after said member has reached its intermediate position; and wherein the valve member further includes abutment surfaces co-operable with said bar and arranged to permit the bar to move the valve member between said open position and said intermediate position, said surfaces being spaced in the axial direction of said rod so as to permit a degree of lost motion between said bar and said valve member after the valve member has reached said intermediate position to permit said cam surfaces to co-operate and urge the valve member into said closed position.

9. A toilet as claimed in claim 8, wherein one of said abutment surfaces is defined by a spring depending from said valve member and having a first portion co-operable with said bar during movement of the valve member from said open position to said intermediate position, and a second portion defining a seat adapted to receive and resiliently retain the bar upon said continued movement of the bar with respect to the valve member.

10. A toilet as claimed in claim 9, wherein said valve member comprises a one-piece plastic moulding and said spring forms an integral part of said moulding.

11. A toilet as claimed in claim 1, further comprising a resevoir for liquid intended for use in flushing said bowl, and pump means communicating with said reservoir and operable to deliver flushing liquid from the reservoir into the bowl in use, wherein said pump means includes an outlet opening defined by a tubular spigot, and nozzle means adapted to be press-fitted onto said spigot and including at least one liquid discharge passageway arranged to permit the discharge of a stream of flushing liquid into the bowl upon operation of said pump means.

12. A toilet as claimed in claim 11 wherein said pump means comprises a piston pump having a cylinder which is formed integrally as part of a plastic moulding, said plastic moulding defining at least a portion of said reservoir and bowl.

13. A toilet as claimed in claim 1, further comprising a reservoir for flushing liquid, and pump means communicating with said reservoir and with said toilet bowl and operable in use to deliver flushing liquid from said reservoir into said bowl;

wherein said reservoir has an inlet opening through which flushing liquid can be introduced into the reservoir and which is normally closed by a vented closure cap, said inlet opening being defined by a tubular inlet member having an inwardly protuberant rib extending around said member adjacent an outer end thereof, and said cap being adapted to be snap-fitted to said member so as to close said outer end, and including a skirt adapted to be received in said member and having an outwardly protuberant formation, said formation and rib being adapted to ride over one another as the cap is fitted to the inlet member and to removably retain the cap on said member.

14. A toilet as claimed in claim 1, further comprising a reservoir for flushing liquid, and pump means communicating with said reservoir and with said toilet bowl and operable in use to deliver flushing liquid from said reservoir into said bowl;

wherein said pump means has an inlet disposed within the reservoir and an outlet arranged to deliver flushing liquid into the bowl when said pump means is operated, and wherein said outlet is provided with a discharge nozzle which incorporates a non-return valve arranged to permit discharge of liquid from said outlet while preventing return flow of liquid from the bowl into said pump means.

15. A toilet as claimed in claim 1, wherein said holding tank further includes an outlet through which waste material can be emptied from the tank and which is normally fitted with a closure cap, said outlet being defined by an outlet member of cylindrical form having an annular compression ridge which extends inwardly around said member adjacent an outer end therof, and said closure cap being adapted to be removably fitted to said member and including a flexible annular lip which projects into said outer end of the outlet when the cap is fitted to said member, said lip being arranged to be deflected inwardly by said compression ridge for providing a seal between said cap and said outlet member.

16. A toilet of the type having a holding tank for waste material, a bowl communicating with a waste material, a bowl communicating with a waste material inlet of said tank, and valve means normally closing said inlet and adapted to be opened to permit waste material to enter the tank from said bowl, wherein said holding tank inlet is provided with a seal defining an annular sealing surface disposed in a sealing plane within said tank, and wherein said valve means comprises:

a valve member which is movable between open closed positions, the valve member being disposed laterally of said inlet in said open position and having a sealing surface adapted to cooperate with said seal in said plane when the valve member is in said closed position;

means supporting said valve member for movement (a) between said open position and an intermediate position in which the valve member is disposed below said inlet preparatory to sealing the same while remaining below said sealing plane, and (b) generally normal to said sealing plane between said intermediate position and said closed position;

actuating means coupled to said valve member and operable from externally of the toilet to move the valve member between said open position and said intermediate position and between said intermediate position and said closed position;

whereby the valve member moves with respect to said annular sealing surface in directions generally normal to said sealing plane for minimizing abrasion of said seal;

wherein said valve member includes pivot formations projecting from respectively opposite sides of the member for permitting pivotal movement of the member between said intermediate position and said closed position, said formations defining an axis disposed adjacent a trailing end of said valve member as considered moving from said open position to said intermediate position, the valve member in said intermediate position being disposed with its sealing surface at an inclination below said sealing plane and so that said sealing surface moves into said plane when the valve member is moved to its closed position;

wherein said means supporting the valve member include respective guide assemblies co-operable with said pivot formations and including respective guide surfaces along which said formations slide as the valve member moves between its said open position and its said intermediate position;

and wherein the toilet further comprises a wiper element disposed adjacent said holding tank inlet and positioned to exert a wiping action on said sealing surface of the valve member as the member moves between said open position and said intermediate position.

* * * * *